US008974304B2

(12) United States Patent
Gagner et al.

(10) Patent No.: US 8,974,304 B2
(45) Date of Patent: Mar. 10, 2015

(54) SYSTEM, METHOD, AND APPARATUS FOR DETECTING ABNORMAL BEHAVIOR OF A WAGERING GAME MACHINE

(75) Inventors: Mark B. Gagner, West Chicago, IL (US); Michael R. Bytnar, Naperville, IL (US); Robertus A. Kloes, London (GB)

(73) Assignee: WMS Gaming Inc., Waukegan, IL (US)

( * ) Notice: Subject to any disclaimer, the term of this patent is extended or adjusted under 35 U.S.C. 154(b) by 1826 days.

(21) Appl. No.: 11/275,280

(22) Filed: Dec. 21, 2005

(65) Prior Publication Data

US 2006/0205488 A1 Sep. 14, 2006

Related U.S. Application Data

(60) Provisional application No. 60/638,864, filed on Dec. 22, 2004.

(51) Int. Cl.
*A63F 9/24* (2006.01)

(52) U.S. Cl.
USPC ..... 463/42; 705/30

(58) Field of Classification Search
USPC ..... 463/42, 21, 29; 705/30, 10, 14; 707/1, 707/5; 709/224; 713/201
See application file for complete search history.

(56) References Cited

U.S. PATENT DOCUMENTS

| | | | | |
|---|---|---|---|---|
| 4,283,709 | A * | 8/1981 | Lucero et al. | 463/25 |
| 6,182,022 | B1 * | 1/2001 | Mayle et al. | 702/182 |
| 6,317,700 | B1 * | 11/2001 | Bagne | 702/181 |
| 6,480,809 | B1 * | 11/2002 | Slaight | 702/186 |
| 6,493,637 | B1 * | 12/2002 | Steeg | 702/19 |
| 6,775,664 | B2 * | 8/2004 | Lang et al. | 1/1 |
| 2002/0152120 | A1 * | 10/2002 | Howington | 705/14 |
| 2004/0019516 | A1 * | 1/2004 | Puskorius et al. | 705/10 |
| 2004/0048669 | A1 * | 3/2004 | Rowe | 463/42 |
| 2004/0133485 | A1 * | 7/2004 | Schoonmaker et al. | 705/30 |
| 2005/0015624 | A1 * | 1/2005 | Ginter et al. | 713/201 |
| 2006/0085370 | A1 * | 4/2006 | Groat et al. | 707/1 |
| 2007/0054722 | A1 * | 3/2007 | De Bruin et al. | 463/16 |

OTHER PUBLICATIONS

*Seminole Tribe of Florida* v. *State of Florida* (S. Hrg. 104-513) May 9, 1996. Appendix: National Indian Gaming Minimum Internal Control Standards Jun. 5,1995, [retrieved on Sep. 11, 2009]. Retrieved from the internet:< URL:http://www.archive.org/details/seminoletribeoff00unit>, pp. 1-5, 410-446 and 499.*

* cited by examiner

*Primary Examiner* — Masud Ahmed
(74) *Attorney, Agent, or Firm* — Nixon Peabody LLP

(57) ABSTRACT

Methods and apparatus for detecting abnormal behavior of a wagering game machine are described herein. In one embodiment, the method includes receiving an operating characteristic value, wherein the operating characteristic value indicates a value of an operating characteristic of a wagering game machine and based on a set of previous operating characteristic values of the operating characteristic, determining whether the operating characteristic value is within a normal operating range. In the embodiment the method also includes performing a fault operation if the operating characteristic value is not within the normal operating range.

14 Claims, 7 Drawing Sheets

SYSTEM, METHOD, AND APPARATUS FOR DETECTING ABNORMAL BEHAVIOR OF A WAGERING GAME MACHINE

RELATED APPLICATION

This application claims priority under 35 U.S.C. 119(e) from U.S. Provisional Application Serial No. 60/638,864 filed Dec. 22, 2004, which application is incorporated herein by reference.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright © 2005, WMS Gaming Inc.

FIELD

This invention relates generally to the field of wagering game machines and more particularly to the field of wagering game machine security.

BACKGROUND

Modem gaming machines (a.k.a. wagering game machines) are becoming increasingly complex, as they are continuously incorporating new technologies. As the gaming industry moves toward commercial operating systems and networking technologies, techniques for verifying system integrity and security are becoming increasingly important. Threats may be accidental (e.g., errors or malfunctions) or malicious (e.g., hackers, computer viruses, or worms).

In complex gaming systems, it can be relatively difficult to detect suspicious or abnormal operating characteristics in a timely manner. Although current wagering game machines employ mechanisms for ensuring authenticity of program code and resources, these mechanisms may be inadequate against sophisticated threats. For example, hackers may find ways to launch legitimate programs at inappropriate times, subvert legitimate programs by altering program arguments, or even embed viruses or worms within legitimate data files. Commercial security software is typically designed to detect specific previously known threats. Unfortunately, such security software typically cannot detect unknown threats.

BRIEF DESCRIPTION OF THE FIGURES

The present invention is illustrated by way of example and not limitation in the Figures of the accompanying drawings in which.

DESCRIPTION OF THE EMBODIMENTS

A system, method, and apparatus for detecting abnormal behavior of a wagering game machine are described herein. This description of the embodiments is divided into four sections. The first section describes an overview, while the second section describes an exemplary operating environment and system architecture. The third section describes exemplary operations and the fourth section provides some general comments.

Overview

This section provides a broad overview of a system for detecting abnormal behavior of a wagering game machine, according to exemplary embodiments of the invention.

Figure 1:
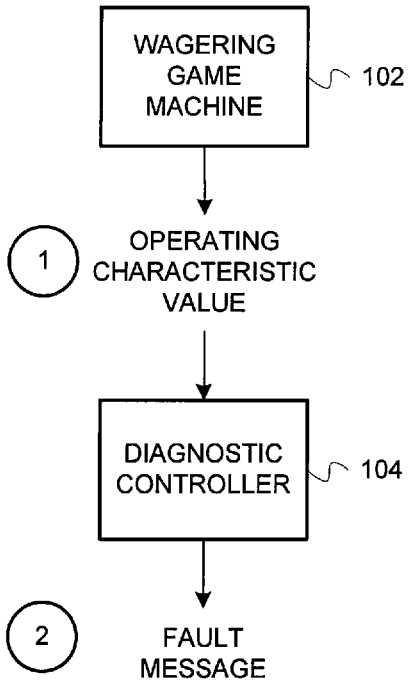
FIG. 1 is a dataflow diagram illustrating dataflow associated with determining abnormal operating characteristics of a wagering game machine, according to exemplary embodiments of the invention.

In a gaming environment, it is possible to detect abnormal wagering game machine behavior by recognizing operating characteristic values that differ from the norm. Operating characteristics can include CPU utilization, memory utilization, processes executing on the CPU, scheduled processes, absence of a process, message activity, etc. Differences may be recognized through the use of rules, algorithms, statistical analysis, fuzzy logic, data mining, etc. FIG. 1 describes data flow associated with determining abnormal operating characteristics of a wagering game machine.

FIG. 1 is a dataflow diagram illustrating dataflow associated with determining abnormal operating characteristics of a wagering game machine, according to exemplary embodiments of the invention. In FIG. 1, the dataflow is divided into in two stages.

At stage one, a wagering game machine 102 transmits an operating characteristic value to a diagnostic controller 104. The operating characteristic value can include a quantification of one or more wagering game machine operating characteristics, such as CPU or memory utilization at a given time.

At stage two, the diagnostic controller 104 determines whether the operating characteristic value (e.g., the wagering game machine's CPU utilization) is within a normal operating range for the wagering game machine. If the operating characteristic value is not with a normal range, the diagnostic controller presents a fault message to game operators.

System Architecture and Operating Environment

This section describes an exemplary wagering game network architecture and operating environment, according to embodiments of the invention. Operations of the system components will be described in the next section.

Figure 2:
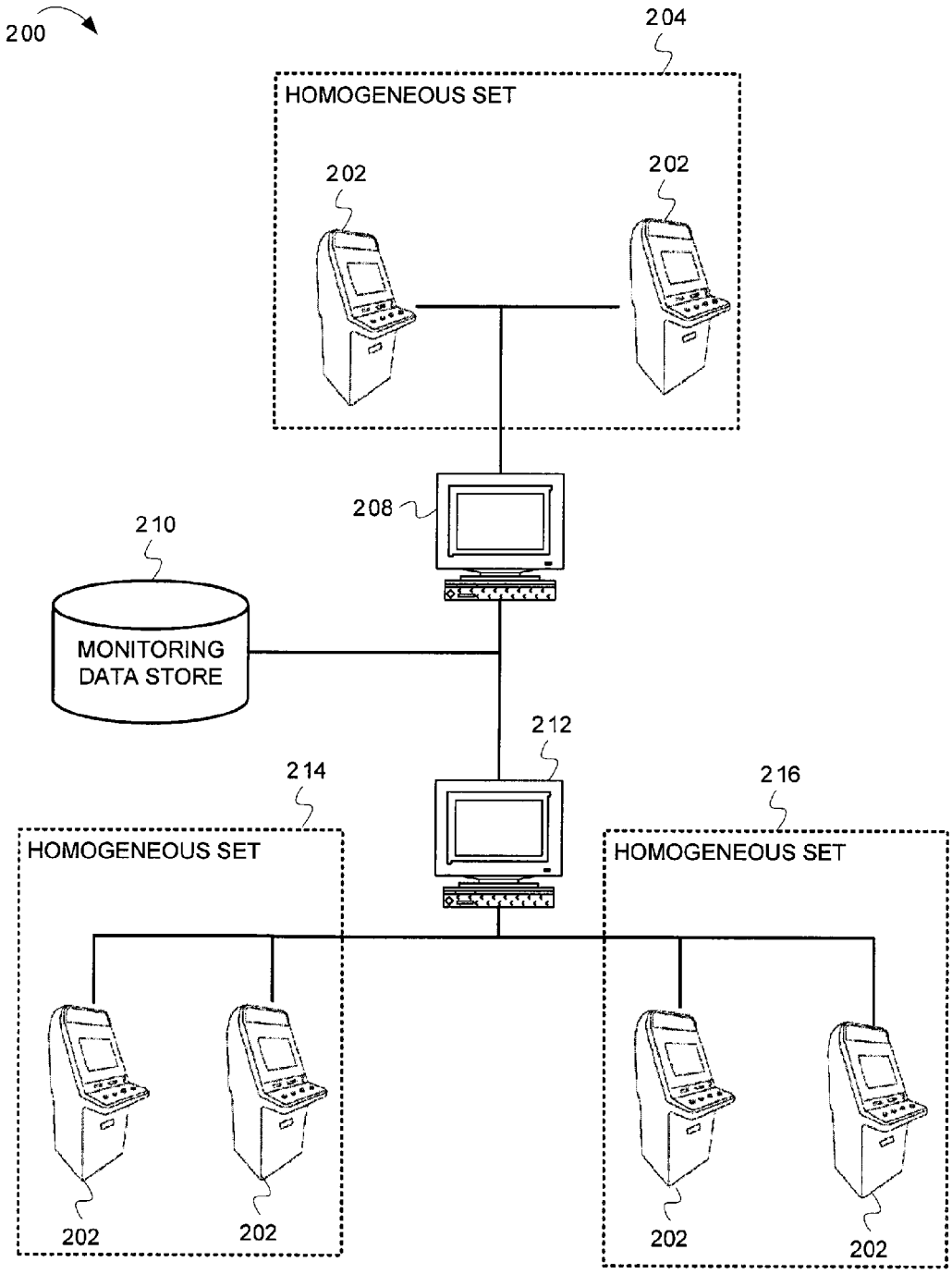
FIG. 2 is a block diagram of a wagering game network, according to embodiments of the invention.

FIG. 2 is a block diagram of a wagering game network, according to embodiments of the invention. As shown in FIG. 2, a wagering game network 200 includes a plurality of wagering game machines 202 and diagnostic controllers 208 and 212. The diagnostic controller 208 is connected to two wagering game machines 212, which form a homogeneous set 204. The diagnostic controller 212 is connected to two homogenous sets 214 and 216.

Each homogeneous set is made up of a group of substantially identical wagering game machines. Wagering game machines are substantially identical when they are running similar or identical software on similar or identical hardware platforms. For example, substantially identical wagering game machines may be running a particular version of Reel-Em-In on a CPU-NXT platform with 256 Mbytes of memory. Substantially identical wagering game machines can be logically grouped together to form homogeneous sets of wagering game machines.

The diagnostic controllers 208 and 212 are connected to a monitoring data store 210. The monitoring data store 210 can store information that characterizes normal and/or correct behavior (i.e., operating conditions) for members of each homogeneous set of the wagering game network 200. The information can relate to all processes running on a wagering game machine 202, processor and memory utilization of the running processes, and sockets, ports and files that are open for the running process. The information can relate to any suitable operating characteristics and can be pre-defined or adaptive. The diagnostic controllers 208 and 212 can use the information for detecting abnormal behavior in the wagering game machines 202.

These components of the wagering game network 200 can communicate over wired and/or wireless connections. For example, the wagering game machines 202 and the diagnostic controllers 208 and 212 can be connected using any suitable connection technology, such as Bluetooth, 802.11x, Ethernet, optical fiber, etc.

Figure 3:
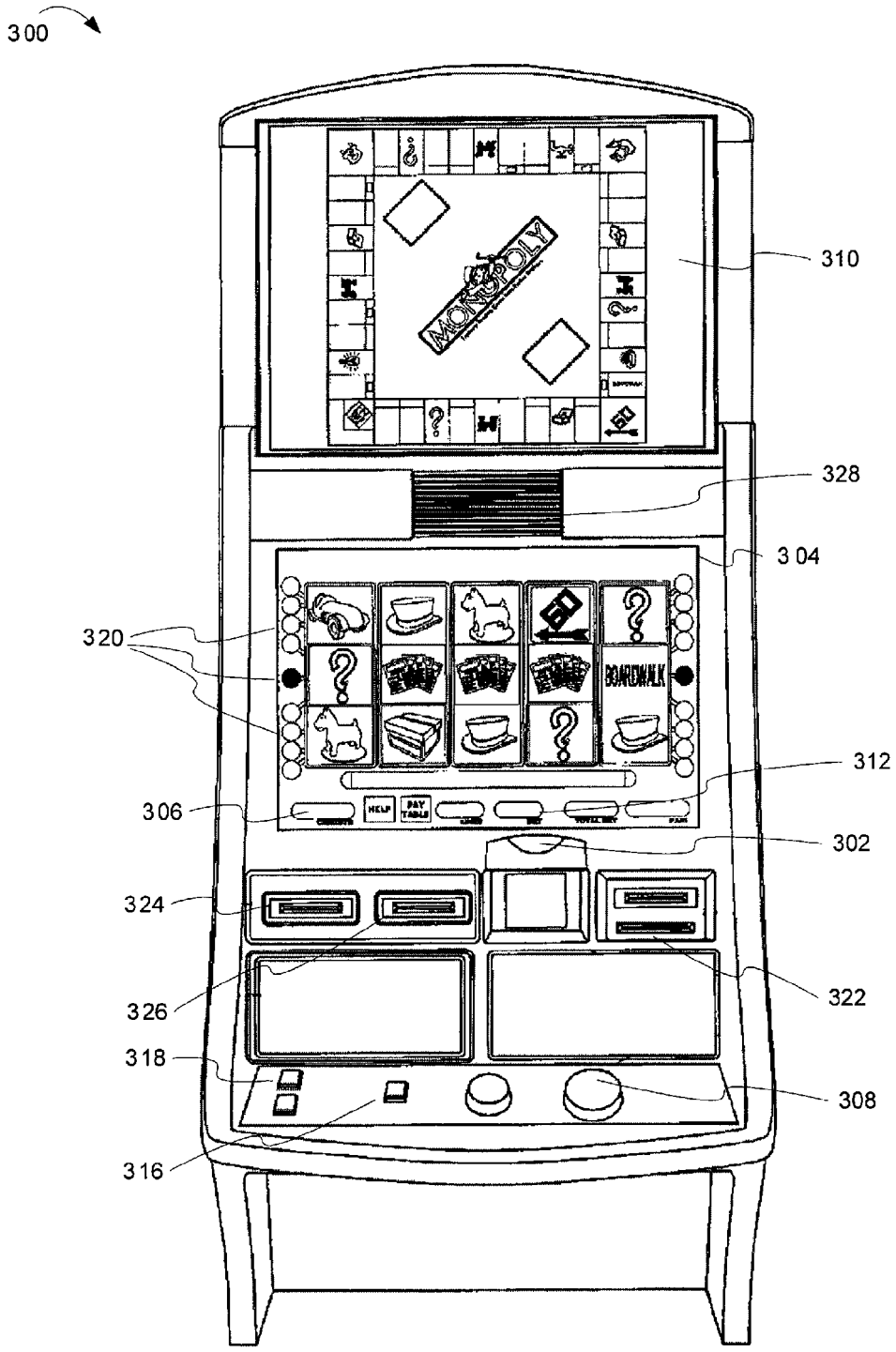
FIG. 3 is a perspective view of a wagering game machine, according to exemplary embodiments of the invention.

While FIG. 2 describes a network architecture for a detecting abnormal wagering game machine behavior, FIG. 3 provides additional details about the wagering game machines.

FIG. 3 is a perspective view of a wagering game machine, according to exemplary embodiments of the invention. In FIG. 3, the wagering game machine 300 can be a computerized slot machine having the controls, displays, and features of a conventional slot machine. The wagering game machine 300 can be operated while players are standing or seated. Additionally, the wagering game machine 300 is preferably mounted on a console. However, the wagering game machine 300 can be constructed as a pub-style tabletop game (not shown), which a player can operate while sitting. Furthermore, the wagering game machine 300 can be constructed with varying cabinet and display designs. The wagering game machine 300 can incorporate any primary game such as slots, poker, or keno, and additional bonus round games. The symbols and indicia used on and in the wagering game machine 300 can take mechanical, electrical, or video form.

As illustrated in FIG. 3, the wagering game machine 300 includes a card reader 322 for accepting player tracking cards. Player tracking cards can include player preferences and other player information. The wagering game machine 300 also includes a coin slot 302 and gaming voucher accepter 324. Players can place coins in the coin slot 302 and paper money or gaming vouchers in the gaming voucher accepter 324.

The wagering game machine 300 can include other devices for accepting payment. For example, credit/debit card readers/validators can be used for accepting payment. Additionally, the wagering game machine 300 can perform electronic funds transfers and financial transfers to procure monies from house financial accounts. When players deposit value into the wagering game machine 300, a number of credits corresponding to the deposit are shown in a credit display 306. After depositing the appropriate amount of money, players can begin playing the game by pushing a play button 308. The play button 308 can be any play activator used for starting a wagering game or sequence of events in the wagering game machine 300.

As shown in FIG. 3, the wagering game machine 300 also includes a bet display 312 and a "bet one" button 316. Player can place a bets by pushing the bet one button 316. Players can increase their bets by one credit by pushing the "bet one" button 316. When players push the bet one button 316, the number of credits shown in the credit display 306 decreases by one credit, while the number of credits shown in the bet display 312 increases by one credit.

Players can "cash-out" by pressing a cash-out button 318. When players cash-out, the wagering game machine's gaming voucher printer 326 may print and dispense gaming vouchers that have value corresponding to the number of remaining credits. The wagering game machine 300 may employ other payout mechanisms such as credit slips (which are redeemable by a cashier) or electronically recordable cards (which track player credits). The wagering game machine 300 can also dispense cash or coins.

The wagering game machine 300 also includes a primary display unit 304 and a secondary display unit 310 (also known as a "top box"). In one embodiment, the primary display unit 304 displays a plurality of video reels 320. According to embodiments of the invention, the display units 304 and 310 can include any visual representation or exhibition, including moving physical objects (e.g., mechanical reels and wheels), dynamic lighting, and video images. In one embodiment, each reel 320 includes a plurality of symbols such as bells, hearts, fruits, numbers, letters, bars or other images, which correspond to a theme associated with the wagering game machine 300. Furthermore, as shown in FIG. 3, the wagering game machine 300 includes an audio presentation unit 328. The audio presentation unit 328 can include audio speakers or other suitable sound projection devices.

Figure 4:
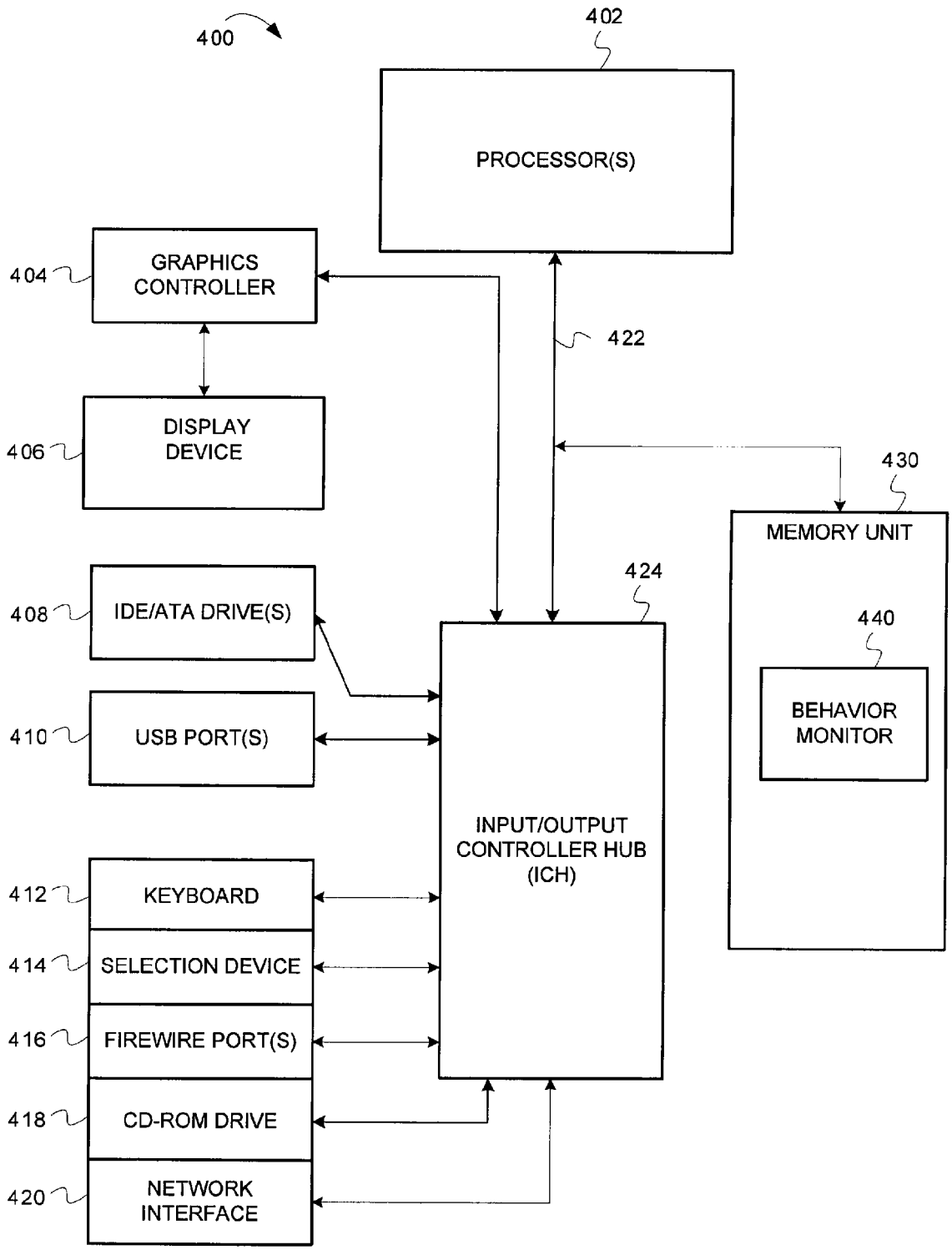
FIG. 4 illustrates a diagnostic controller for monitoring wagering game machine behavior in a wagering game network, according to exemplary embodiments of the invention.
Figure 5:
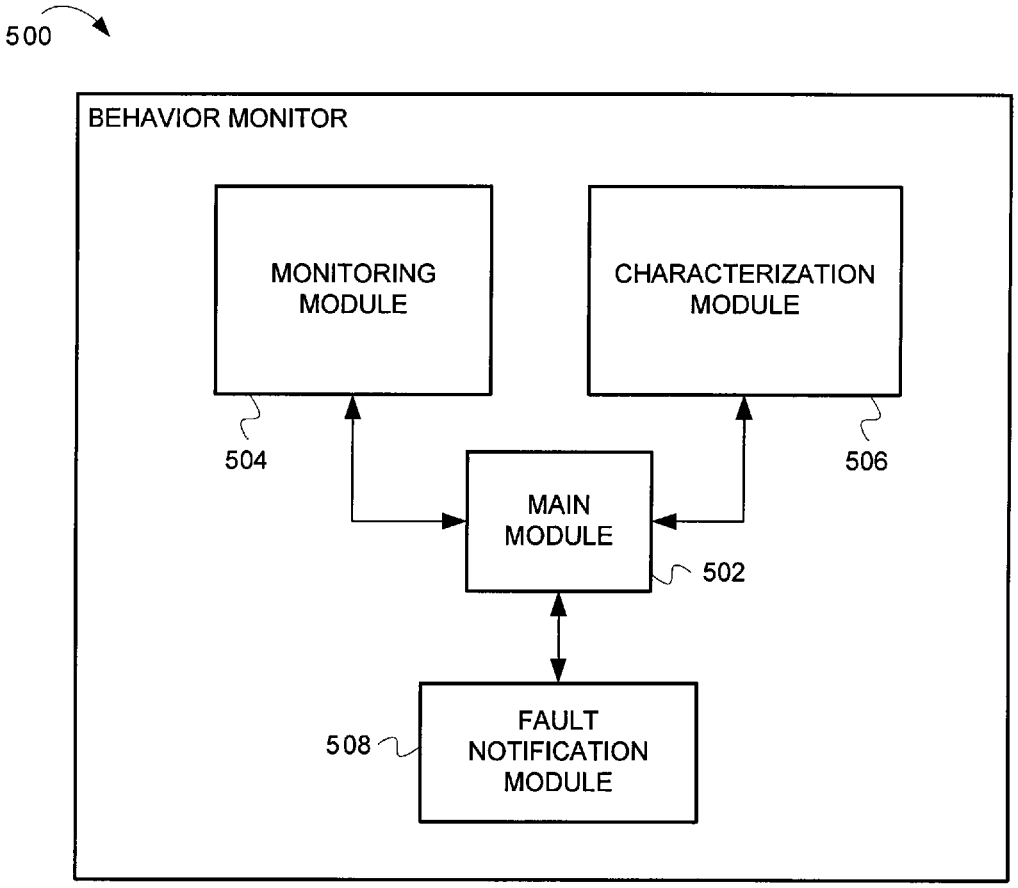
FIG. 5 is a block diagram illustrating a behavior monitor, according to exemplary embodiments of the invention.

In one embodiment, a plurality of wagering game machines can be connected together to form homogeneous sets in a wagering game network (see discussion of FIG. 2 above). In one embodiment, the wagering game machine 300 can transmit operating characteristic values to a diagnostic controller, which can detect abnormal wagering game machine behavior. FIGS. 4 and 5 describe diagnostic controllers, according to exemplary embodiments of the invention.

FIG. 4 illustrates a diagnostic controller for monitoring wagering game machine behavior in a wagering game network, according to exemplary embodiments of the invention. The diagnostic controllers shown in FIG. 2 can include the components described with reference to FIG. 4.

In FIG. 4, the diagnostic controller 400 comprises a processor 402. The diagnostic controller 400 also includes a memory unit 430, processor bus 422, and Input/Output controller hub (ICH) 424. The processor 402, memory unit 430, and ICH 424 are coupled to the processor bus 422. The processor 402 may comprise any suitable processor architecture, which may execute a set of instructions in accordance with embodiments of the present invention.

In one embodiment, the memory unit 430 includes a behavior monitor 440. The behavior monitor 440 can perform operations for detecting abnormal behavior in a wagering game machine. These operations will be described in more detail below, in the next section. A more detailed embodiment of the behavior monitor 440 is described in greater detail below, in the discussion of FIG. 5.

The memory unit 430 stores data and/or instructions, and may comprise any suitable memory, such as a dynamic random access memory (DRAM), for example. The diagnostic controller 400 also includes IDE drive(s) 408 and/or other suitable storage devices. A graphics controller 404 controls the display of information on a display device 406, according to embodiments of the invention.

The input/output controller hub (ICH) 424 provides an interface to I/O devices or peripheral components for the diagnostic controller 400. The ICH 424 may comprise any suitable interface controller to provide for any suitable communication link to the processor 402, memory unit 430 and/or to any suitable device or component in communication with the ICH 424. For one embodiment of the invention, the ICH 424 provides suitable arbitration and buffering for each interface.

For one embodiment of the invention, the ICH 424 provides an interface to one or more suitable integrated drive electronics (IDE) drives 408, such as a hard disk drive (HDD) or compact disc read only memory (CD ROM) drive, or to suitable universal serial bus (USB) devices through one or more USB ports 410. For one embodiment, the ICH 424 also provides an interface to a keyboard 412, a mouse 414, a CD-ROM drive 418, and one or more suitable devices through one or more firewire ports 416. For one embodiment of the invention, the ICH 424 also provides a network interface 420 though which the diagnostic controller 400 can communicate with other computers and/or devices.

In one embodiment, the diagnostic controller 400 includes a machine-readable medium that stores a set of instructions (e.g., software) embodying any one or all of the methodologies for detecting abnormal behavior of a wagering game machine. Furthermore, software can reside, completely or at least partially, within memory unit 430 and/or within the processor 402.

FIG. 5 is a block diagram illustrating a behavior monitor, according to exemplary embodiments of the invention. In FIG. 5, a behavior monitor 500 includes a main module 502, which is connected to a monitoring module 504, characterization module 506, and fault notification module 508.

In one embodiment, the monitoring module 504 monitors operating characteristics of wagering game machines in a homogeneous set, while the characterization module 506 determines whether the values for the operating characteristics are within ranges that are normal for the wagering game machines. The fault notification module 508 performs fault notification operations, such as logging errors and transmitting security warnings. The main module 502 controls operations of the other modules. Operations of the behavior monitor 500 are described in greater detail below.

According to embodiments of the invention, the modules of the behavior monitor 500 can be integrated or divided, forming any number of modules. According to embodiments, the modules can include queues, stacks, or other data structures necessary for performing the functionality described herein. Moreover, the modules can be communicatively coupled using any suitable communication method (message passing, parameter passing, signals, etc.).

Any of the modules used in conjunction with embodiments of the invention can include machine-readable media for performing operations described herein. Machine-readable media includes any mechanism that provides (i.e., stores and/or transmits) information in a form readable by a machine (e.g., a computer). For example, a machine-readable medium includes read only memory (ROM), random access memory (RAM), magnetic disk storage media, optical storage media, flash memory devices, electrical, optical, acoustical or other forms of propagated signals (e.g., carrier waves, infrared signals, digital signals, etc.), etc. According to embodiments of the invention, the modules can be other types of logic (e.g., digital logic) for executing the operations for detecting abnormal behavior of a wagering game machine.

System Operations

This section describes operations performed by embodiments of the invention. In certain embodiments, the operations are performed by instructions residing on machine-readable media (e.g., software), while in other embodiments, the methods are performed by hardware or other logic (e.g., digital logic).

In this section, FIGS. 6 and 7 will be discussed. In particular, FIG. 6 describes operations for detecting abnormal wagering game machine behavior, while FIG. 7 describes operations for transmitting operating characteristics values.

Figure 6:
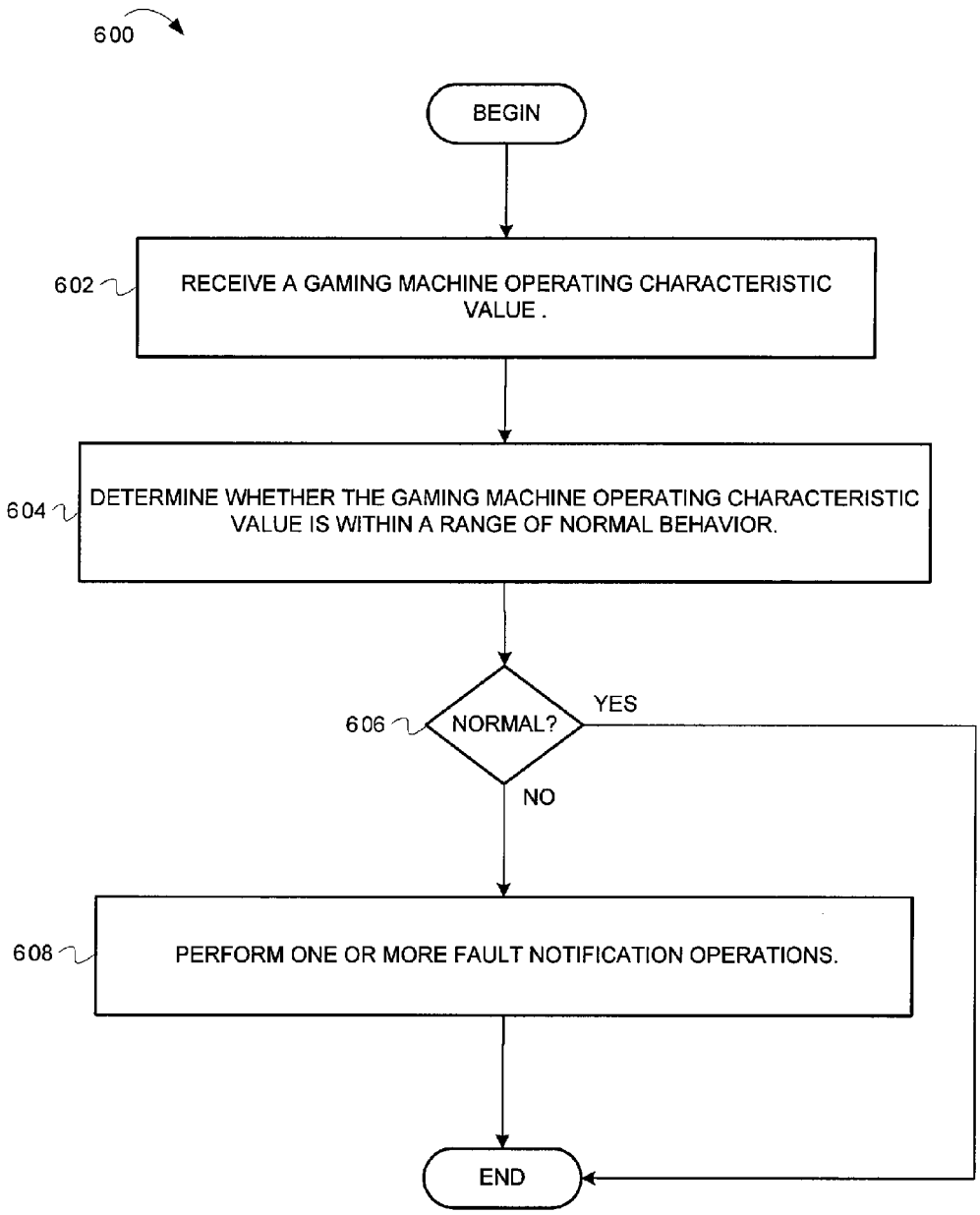
FIG. 6 is a flow diagram illustrating operations for detecting abnormal wagering game machine behavior, according to exemplary embodiments of the invention.

FIG. 6 is a flow diagram illustrating operations for detecting abnormal wagering game machine behavior, according to exemplary embodiments of the invention. The flow diagram 600 will be described with reference to the above-described block diagrams. The flow diagram 600 commences at block 602.

At block 602, an operating characteristic value is received. For example, the diagnostic controller 208 receives an operating characteristic value from a wagering game machine 202 of the homogeneous set 204. In one embodiment, the diagnostic controller's behavior monitor 500 receives the operating characteristic value in its monitoring module 504. The flow continues at block 604.

At block 604, a determination is made about whether the operating characteristic value is within a range of normal behavior. For example, the behavior controller's characterization module 506 determines whether the operating characteristic value is within a normal operating range.

The behavior controller 500 can use any suitable method for determining whether the operating characteristic value is within a normal operating range. For example, the behavior controller 500 can use rules, algorithms, statistical analysis, fuzzy logic, data mining, neural networks, etc. In one embodiment, the characterization module 506 determines whether the value is within a normal operating range by comparing the operating characteristic value with values of a predetermined data set. The predetermined data set can include previous operating characteristic values sampled from a homogeneous set of wagering game machines. The predetermined data set can include values sampled from wagering game machines during secure and uncompromised conditions (e.g., a simulated gaming environment or a secure testing environment) or values sampled during normal operating conditions (e.g., a casino environment). In one embodiment all values obtained during the secure and uncompromised conditions are used to create a database of values within a normal range of behavior.

The data set can be statistically verified with varying degrees of confidence. A data set's confidence factor can be influenced by sample size and ability to verify wagering game machine security. In one embodiment, after the monitoring module 504 determines whether the operating characteristic value is within a normal operating range, the characterization module 506 updates the data set. For example, the characterization module 506 can increase the confidence factor or recalculate the normal range based on the operating characteristic value received at block 602.

In one embodiment the behavior controller 500 alerts a human operator of a possible fault and the operator determines whether the operating characteristic is within a normal range. In one embodiment, based on the human operator's determination, the characterization module 506 updates the data set.

The flow 600 continues at block 606.

At block 606, if the operating characteristic value is within a normal operating range, the flow continues at block 608. Otherwise the flow ends.

At block 608, fault notification operations are performed. For example, the behavior monitor's fault notification module 508 performs fault operations. In one embodiment, the fault notification module 508 performs fault operations, such as transmitting a message to a printer, adding a message to a message log, transmitting a message to security personnel, disabling the wagering game machine, etc. In one embodiment, the fault notification module 508 performs different fault operations depending on confidence factors. For example, if the monitoring module 504 has high confidence that an operating characteristic value is abnormal, the fault notification module 508 can disable the wagering game machine or notify security personnel. However, if the monitoring module 504 has a low degree of confidence that an operating characteristic value is abnormal, the fault notification module 508 may send a message to a printer or message log. From block 608, the flow ends.

Figure 7:
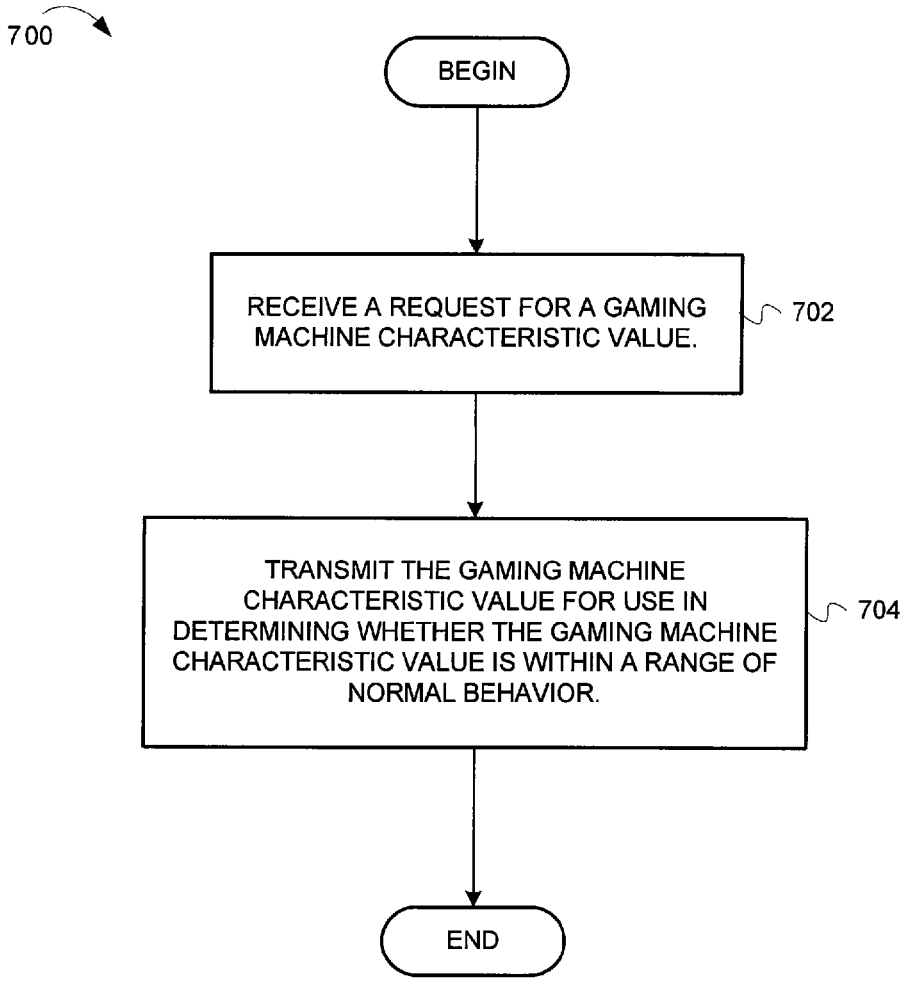
FIG. 7 is a flow diagram illustrating operations for transmitting operating characteristic values to a diagnostic controller, according to exemplary embodiments of the invention.

While FIG. 6 describes operations for detecting abnormal wagering game machine behavior, FIG. 7 describes operations for transmitting operating characteristic values to a diagnostic controller.

FIG. 7 is a flow diagram illustrating operations for transmitting operating characteristic values to a diagnostic controller, according to exemplary embodiments of the invention. The flow diagram 700 will be described with reference the exemplary wagering game network of FIG. 2.

At block 702, a request for an operating characteristic value is received. For example, a wagering game machine 202 receives from the diagnostic controller 208 a request for an operating characteristic value. Alternatively, in one embodiment, the wagering game machine 202 does not receive requests from the diagnostic controller 208. Instead, the wagering game machine 202 includes a process for sampling operating characteristic values for later transmission to the diagnostic controller 208. The flow continues at block 704.

At block 704, an operating characteristic value is transmitted for use in determining whether the value is within a normal operating range. For example, the wagering game machine 202 transmits an operating characteristic value to the diagnostic controller 208. In one embodiment, the diagnostic controller 208 uses the operating characteristic value to determine whether the value is within a normal operating range.

In one embodiment, the diagnostic controller 208 determines that the value is not within a normal operating range, and based on the determination, transmits a signal to the wagering game machine 202. Based on the signal, the wagering game machine 202 ceases to operate or enters an unplayable state. In one embodiment, the diagnostic controller 208 generates and transmits periodic signals to the wagering game machine 202. The periodic signals are generated when the diagnostic controller 208 determines that one or more operating characteristic values are within a normal operating range. If the wagering game machine 202 does not receive a periodic signal, the wagering game machine 202 ceases to operate or enters an unplayable state. From block 704, the flow ends.

General

In this description, numerous specific details are set forth. However, embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment, but such embodiments are not necessarily mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description. Moreover, in this description, the phrase "exemplary embodiment" means that the embodiment being referred to serves as an example or illustration.

Herein, block diagrams illustrate exemplary embodiments of the invention. Also herein, flow diagrams illustrate operations of the exemplary embodiments of the invention. The operations of the flow diagrams are described with reference to the exemplary embodiments shown in the block diagrams. However, the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may perform less than all the operations shown in a particular flow diagram. Moreover, although the flow diagrams depict serial operations, certain embodiments could perform certain of those operations in parallel.

The invention claimed is:

1. A method for detecting abnormal behavior within a gaming network, the network including a set of homogeneous wagering game machines, the network including a behavior monitoring device remote from the set of homogeneous wagering game machines, the method comprising:

receiving, at the behavior monitoring device, a value of an operating characteristic from one or more machines in the set of homogeneous wagering game machines;

determining, by the behavior monitoring device, whether the value of the operating characteristic is within a normal operating range, statistically verifying, by the behavior monitoring device, the value of the operating characteristic with a confidence factor selected from a plurality of confidence factors;

initially determining, by the behavior monitoring device, that the value of the operating characteristic is outside the normal operating range and selecting (a) a first fault notification operation from a set of different fault notification operations if the confidence factor is a first confidence factor, or (b) a second fault notification operation from the set of different fault notification operations if the confidence factor is a second confidence factor;

performing, by the behavior monitoring device, the selected first fault notification operation or second fault notification operation and, subsequently, determining that the value of the operating characteristic is within the normal operating range by monitoring values of a predetermined data set that determine the normal operating range, learning that the value of the operating characteristic should be included in the values of the predetermined data set, and updating the values of the predetermined data set to include the value of the operating characteristic.

2. The method of claim 1, further comprising increasing the confidence factor after determining that the value of the operating characteristic is within the normal operating range.

3. The method of claim 1, wherein the set of different fault notification operations includes one or more of notifying casino security, recording a message in a message log, disabling the wagering game machine, or presenting a message to a display device.

4. The method of claim 1, wherein the operating characteristic includes one or more of processor utilization, memory utilization, absence of a process, presence of a process, sockets opened, ports opened, or message activity.

5. A system comprising:

a set of homogeneous wagering game machines to transmit a value of an operating characteristic;

a data store to store the value of the operating characteristic and a predetermined data set representative of a normal operating range; and a diagnostic controller remote from the set of homogenous wagering gaming machines and configured to receive the value of the operating characteristic determine whether the value of the operating characteristic is within the normal operating range, statistically verify the value of the operating characteristic with a confidence factor selected from a plurality of confidence factors, initially determine that the value of the operating characteristic is outside the normal operating range and select (a) a first fault notification operation from a set of different fault notification operations if the confidence factor is a first confidence factor, or (b) a second fault notification operation from the set of different fault notification operations if the confidence factor is a second confidence factor, perform the selected first fault notification operation or second fault notification operation and, subsequently, determine that the value of the operating characteristic is within the normal operating range by monitoring values of a predetermined data set that determine the normal operating range, learning that the value of the operating characteristic should be included in the values of the predetermined data set, and updating the values of the predetermined data set to include the value of the operating characteristic.

6. The system of claim 5, wherein the diagnostic controller further performs one or more of a statistical analysis, a fuzzy logic, and data mining to determine whether the value of the operating characteristic is within the normal operating range.

7. The system of claim 5, wherein the operating characteristic is selected from a group consisting of identities of processes executing on a wagering game machine of the set of homogeneous wagering game machines, processor utilization of the processes executing on the wagering game machine, memory utilization of the processes executing on the wagering game machine, and files open for the processes executing on the wagering game machine.

8. The system of claim 5, wherein, prior to being updated, the values of the predetermined data set were obtained in a testing environment.

9. The system of claim 8, wherein the testing environment is a secure testing environment, and wherein the values of the predetermined data set are used to build a database of operating characteristic values within a range of normal behavior.

10. The system of claim 8, wherein the testing environment is a casino environment.

11. A non-transitory machine-readable storage medium including instructions for detecting abnormal behavior within a gaming network including a set of homogeneous wagering game machines, the instructions when executed by a machine, perform operations comprising:

receiving, at a behavior monitoring device, a value of an operating characteristic from one or more machines in the set of homogeneous wagering game machines;

determining, by the behavior monitoring device, whether the value of the operating characteristic is within a normal operating range, statistically verifying, by the behavior monitoring device, the value of the operating characteristic with a confidence factor selected from a plurality of confidence factors;

initially determining, by the behavior monitoring device, that the value of the operating characteristic is outside the normal operating range and selecting (a) a first fault notification operation from a set of different fault notification operations if the confidence factor is a first confidence factor, or (b) a second fault notification operation from the set of different fault notification operations if the confidence factor is a second confidence factor;

performing, by the behavior monitoring device, the selected first fault notification operation or second fault notification operation and, subsequently, determining that the value of the operating characteristic is within the normal operating range by monitoring values of a predetermined data set that determine the normal operating range, learning that the value of the operating characteristic should be included in the values of the predetermined data set, and updating the values of the predetermined data set to include the value of the operating characteristic.

12. The non-transitory machine-readable storage medium of claim 11, the operations further comprising increasing the confidence factor after determining that the value of the operating characteristic is within the normal operating range.

13. The non-transitory machine-readable storage medium of claim 11, wherein the set of different fault notification operations includes one or more of notifying casino security, recording a message in a message log, disabling the wagering game machine, or presenting a message to a display device.

14. The non-transitory machine-readable storage medium of claim 11, wherein the operating characteristic includes one or more of processor utilization, memory utilization, absence of a process, presence of a process, sockets opened, ports opened, or message activity.

* * * * *